US008511472B2

(12) United States Patent
Dupuis et al.

(10) Patent No.: US 8,511,472 B2
(45) Date of Patent: Aug. 20, 2013

(54) CONTAINERS HAVING PERFORATED SHRINK WRAP SLEEVES

(75) Inventors: Glen A. Dupuis, Westport, CT (US); Katherine Lucisano, New York, NY (US); Piaras Valdis de Cleir, Tarrytown, NY (US)

(73) Assignee: Kraft Foods Group Brands LLC, Northfield, IL (US)

( * ) Notice: Subject to any disclaimer, the term of this patent is extended or adjusted under 35 U.S.C. 154(b) by 0 days.

(21) Appl. No.: 13/460,633

(22) Filed: Apr. 30, 2012

(65) Prior Publication Data

US 2012/0211526 A1 Aug. 23, 2012

Related U.S. Application Data

(63) Continuation of application No. PCT/US2011/047750, filed on Aug. 15, 2011.

(60) Provisional application No. 61/374,027, filed on Aug. 16, 2010.

(51) Int. Cl.
*B65D 65/00* (2006.01)
*B65D 71/08* (2006.01)

(52) U.S. Cl.
USPC ..... 206/497

(58) Field of Classification Search
USPC ..... 206/497, 139, 432, 822, 457; 229/87.01
See application file for complete search history.

(56) References Cited

U.S. PATENT DOCUMENTS

| | | | |
|---|---|---|---|
| D31,399 | S | 8/1899 | Case |
| D139,331 | S | 10/1944 | Teunisz |
| D169,642 | S | 5/1953 | Clair |
| 2,954,139 | A | 9/1960 | Owens |
| 3,189,208 | A | 6/1965 | Jowett |
| D202,662 | S | 10/1965 | Williams |
| D206,686 | S | 1/1967 | Platte |
| 3,733,002 | A | 5/1973 | Fujio |
| 3,746,201 | A | 7/1973 | Fujio |
| 3,873,018 | A | 3/1975 | Donnay |

(Continued)

FOREIGN PATENT DOCUMENTS

| | | |
|---|---|---|
| WO | 95/11168 A1 | 4/1995 |
| WO | 00/48161 A2 | 8/2000 |

OTHER PUBLICATIONS

International Search Report for PCT/US2011/047750, mailed Sep. 13, 2011 (4 pgs.).

(Continued)

*Primary Examiner* — Luan K Bui
*Assistant Examiner* — Rafael Ortiz
(74) *Attorney, Agent, or Firm* — Fitch, Even, Tabin & Flannery LLP

(57) ABSTRACT

A container having a container body that can have a circumference/perimeter variation along a vertical axis, a bottom surface, and a container opening having a top surface; an axially oriented shrink wrap sleeve covering a portion of the body of the container having a circumference variation and the container opening; the shrink wrap sleeve having a pair of generally vertical perforations descending from the shrink wrap top edge towards a circumferential perforation ring oriented below the container opening. The axially oriented shrink wrap sleeve covering a portion of the container body circumference variation has a greater or lesser circumference at at least one point between the perforation ring and the bottom edge of the shrink wrap.

28 Claims, 7 Drawing Sheets

(56) References Cited

U.S. PATENT DOCUMENTS

D240,829 S 8/1976 Jones et al.
4,000,824 A 1/1977 Han
4,124,151 A 11/1978 Hazard
D265,060 S 6/1982 Blank
4,358,032 A 11/1982 Libit
D282,441 S 2/1986 Shiokawa
D292,882 S 11/1987 Gross
4,758,456 A 7/1988 Muscala
4,903,843 A 2/1990 Fischer
D308,824 S 6/1990 Wiseman et al.
4,976,798 A 12/1990 Hoffman
D316,369 S 4/1991 Thompson
D317,869 S 7/1991 Kipperman et al.
5,038,974 A 8/1991 DaCosta
D320,746 S 10/1991 Bolen, Jr. et al.
D322,220 S 12/1991 Pisar
D332,749 S 1/1993 Pisar
D336,614 S 6/1993 Crawford
5,292,018 A 3/1994 Travisano
D347,389 S 5/1994 Crawford
5,315,785 A * 5/1994 Avot et al. ..... 47/72
D349,057 S 7/1994 Farce
D349,058 S 7/1994 Farce
5,375,718 A 12/1994 Honma et al.
5,511,664 A 4/1996 Aramaki et al.
5,605,230 A 2/1997 Marino, Jr.
D382,803 S 8/1997 Gavin
D387,673 S 12/1997 Crawford
D391,855 S 3/1998 Fenton et al.
D413,265 S 8/1999 Hestehave et al.
D419,455 S 1/2000 Macauley et al.
D427,073 S 6/2000 Gaffney et al.
D435,098 S 12/2000 Kemmis et al.
D438,459 S 3/2001 Holthaus
D447,953 S 9/2001 Brynestad et al.
D457,437 S 5/2002 Sadeghi et al.
6,385,878 B1 * 5/2002 Key ..... 40/306
D463,744 S 10/2002 Brozell
D463,747 S 10/2002 Peon et al.
6,460,781 B1 10/2002 Garcia et al.
D471,818 S 3/2003 Weber
D471,819 S 3/2003 Paul et al.
6,598,808 B1 7/2003 Garcia et al.
D481,636 S 11/2003 Camacho
D482,286 S 11/2003 Samson et al.
6,663,019 B2 12/2003 Garcia et al.
D486,065 S 2/2004 Hutchinson et al.
D486,398 S 2/2004 Lovell et al.
6,746,744 B1 6/2004 Ishihara et al.
6,779,689 B2 8/2004 Flaig et al.
6,783,035 B2 8/2004 Garcia et al.
D498,415 S 11/2004 Schuller et al.
6,837,405 B2 1/2005 Rainey et al.
D510,029 S 9/2005 Marcot
D520,873 S 5/2006 Lovell
D525,136 S 7/2006 Bakie
D525,872 S 8/2006 Haubert et al.
D525,873 S 8/2006 Haubert et al.
D526,204 S 8/2006 Stolle
D527,640 S 9/2006 Cummings et al.
D527,644 S 9/2006 Bakie
D528,004 S 9/2006 Ratzlaff
D529,388 S 10/2006 Bakie
D529,810 S 10/2006 Davies et al.
D529,811 S 10/2006 Ratzlaff
D529,812 S 10/2006 Ratzlaff
7,147,131 B2 12/2006 Sher et al.
D536,975 S 2/2007 Smith et al.
D537,721 S 3/2007 Kertels
D538,668 S 3/2007 Campbell et al.
D539,652 S 4/2007 Moretti
D540,176 S 4/2007 Flurer et al.
D542,140 S 5/2007 Garcia-Ruiz
D542,141 S 5/2007 Okin et al.
D543,115 S 5/2007 Flurer et al.
D543,861 S 6/2007 Garcia-Ruiz
D544,351 S 6/2007 Dittmer et al.
D547,190 S 7/2007 Kuzma et al.
D554,515 S 11/2007 Toh
D563,226 S 3/2008 Mongeon et al.
D563,789 S 3/2008 Mongeon et al.
D565,959 S 4/2008 Hadtke
D574,246 S 8/2008 Russell et al.
D577,592 S 9/2008 Goetz et al.
D577,593 S 9/2008 Hestehave
D578,007 S 10/2008 Hestehave
D578,399 S 10/2008 Hestehave
D579,338 S 10/2008 Hestehave
D580,767 S 11/2008 Okin et al.
D581,279 S 11/2008 Oates
D581,794 S 12/2008 Haubert, III et al.
D584,159 S 1/2009 Domoy et al.
D585,289 S 1/2009 Toh
D585,290 S 1/2009 Toh
D585,740 S 2/2009 Wilson et al.
D585,741 S 2/2009 Wilson et al.
D585,742 S 2/2009 Wilson et al.
D587,117 S 2/2009 Crawford
D588,459 S 3/2009 Davis et al.
D588,460 S 3/2009 Davis et al.
D588,461 S 3/2009 Davis et al.
D588,462 S 3/2009 Davis et al.
D590,259 S 4/2009 Kunesh et al.
D591,599 S 5/2009 Okin et al.
D592,957 S 5/2009 Davis et al.
D595,138 S 6/2009 Ames et al.
D598,752 S 8/2009 Wilson et al.
D601,899 S 10/2009 Davis et al.
D602,356 S 10/2009 Shurtleff et al.
D605,512 S 12/2009 Weber
D605,945 S 12/2009 Macaulay et al.
D608,645 S 1/2010 Handy et al.
D608,648 S 1/2010 Rhodes et al.
D609,098 S 2/2010 Almstead, Jr. et al.
D610,022 S 2/2010 Kanfer et al.
7,661,352 B2 2/2010 Sher et al.
D614,488 S 4/2010 Kallenbach et al.
D624,424 S 9/2010 Fiore et al.
D628,488 S 12/2010 Johnson et al.
D628,490 S 12/2010 Sato et al.
D629,303 S 12/2010 Toh et al.
D636,267 S 4/2011 Shiota et al.
D637,916 S 5/2011 McNabb et al.
D638,713 S 5/2011 de Cleir et al.
D638,714 S 5/2011 de Cleir et al.
D638,715 S 5/2011 Albaum et al.
D644,106 S 8/2011 Almstead, Jr. et al.
D650,679 S 12/2011 de Cleir et al.
D650,686 S 12/2011 de Cleir et al.
D657,682 S 4/2012 de Cleir et al.
2005/0035081 A1 2/2005 Fitch
2007/0023453 A1 2/2007 Simkins
2007/0084735 A1 * 4/2007 Lancesseur et al. ..... 206/204
2007/0102455 A1 5/2007 Stark et al.
2007/0253761 A1 11/2007 May
2010/0224646 A1 * 9/2010 Incorvia et al. ..... 220/839
2011/0204049 A1 * 8/2011 Weder et al. ..... 220/4.24

OTHER PUBLICATIONS

Line drawing of sleeve and photographs of Parmesan cheese container of the type believed to have been publicly available in Japan more than a year prior to Aug. 16, 2010 (4 pgs.).
Design U.S. Appl. No. 29/398,068, filed Jul. 26, 2011, (5 pages).
Design U.S. Appl. No. 29/398,077, filed Jul. 26, 2011, (10 pages).

* cited by examiner

CONTAINERS HAVING PERFORATED SHRINK WRAP SLEEVES

CROSS-REFERENCE TO RELATED APPLICATIONS

This application is a continuation of International Appl. No. PCT/US2011/047750, filed Aug. 15, 2011, which claims the benefit of U.S. Appl. No. 61/374,027, filed Aug. 16, 2010, both of which are hereby incorporated by reference in their entirety.

FIELD

The present products and methods relate to packaging, and in particular to easy open containers having a perforated shrink wrap sleeve.

BACKGROUND

Sealing product containers, labeling container contents and providing evidence that a container has not been opened are known using heat-shrinkable films ('shrink wrap'). Applying such films are described in U.S. Pat. No. 6,296,129 to Kawasaki and U.S. Pat. No. 5,605,230 to Marino et al., the specifications of which are incorporated by reference. Shrink wrap applications can be economically applied to a variety of containers for a variety of products, such as food or pharmaceutical applications.

Despite the advantages of heat shrink films, shrink wrap packaging can sometimes be difficult for irregularly shaped containers. In such cases, shrink wrap can be difficult to apply, difficult to remove, and difficult to provide printed matter without noticeable distortion.

SUMMARY

Accordingly, provided herein are embodiments for perforated shrink wrap sleeves and containers with perforated shrink wrapped sleeves configured to provide easy partial removal, evidence of tamper, and product labeling—even with irregularly shaped and non-symmetrical containers.

A preferred embodiment provides a container having a container body that can have a circumference/perimeter variation along a vertical axis, a bottom surface, and a container opening having a top surface; an axially oriented shrink wrap sleeve covering a portion of the body of the container having a circumference variation and the container opening, a top edge of the shrink wrap sleeve allowing the top surface to remain exposed, and bottom edge of the shrink wrap sleeve allowing the bottom surface to remain exposed; the shrink wrap sleeve having a pair of generally vertical perforations descending from the shrink wrap top edge towards a circumferential perforation ring oriented below the container opening. In some embodiments, the axially oriented shrink wrap sleeve covering a portion of the container body circumference variation has a greater circumference as compared to adjacent portions of the circumference variation at at least one point between the shrink wrap top (or alternately shrink wrap circumferential perforation ring) and bottom edges.

In other embodiments the axially oriented shrink wrap sleeve covering a portion of the container body circumference variation can have a smaller circumference as compared to adjacent portions of the circumference variation at at least one point between the shrink wrap horizontal perforations and bottom edges. Circumference variation can be in the range of about 5 percent to about 200 percent, and preferably about 100 percent.

Generally vertical perforations descending from the shrink wrap top edge can converge progressively closer together as they approach the circumferential ring. The vertical perforations descending from the shrink wrap top edge can terminate at the circumferential ring or alternately about two perforations above the circumferential ring. Such a distance corresponds to the length between two perforations or more of the generally vertical perforations.

In other embodiments, the shrink wrap vertical perforations descending from the shrink wrap top edge can begin with an initial perforation cut, followed by proportionally smaller perforation cuts, configured so that when the shrink wrap is applied to the container body, the larger cut forms as 'V' shape at a top of each vertical perforation to define a tab between the vertical perforations.

The container body can generally have a planar front and rear surface, and a seal of the shrink wrap is vertically oriented along an edge of the rear surface.

In a specific embodiment, the container can have a container body having a vertical axis, a bottom surface, and a container opening having a top surface; a vertically oriented shrink wrap sleeve covering a portion of the container body and the container opening, a top edge of the shrink wrap sleeve allowing the top surface to remain exposed, and bottom edge of the shrink wrap sleeve allowing the bottom surface to remain exposed; the shrink wrap sleeve having a pair of generally vertical perforations descending from the shrink wrap sleeve top edge towards a circumferential perforation ring oriented below the container opening.

In another specific embodiment, the container can have a container body having a circumference variation along a vertical axis, a bottom surface, and a container opening having a top surface; a vertically oriented shrink wrap sleeve covering a portion of the circumference variation of the container body and the container opening, a top edge of the shrink wrap sleeve allowing the top surface to remain exposed, and bottom edge of the shrink wrap sleeve allowing the bottom surface remain exposed; the shrink wrap sleeve having a pair of generally vertical perforations descending from a distance below the shrink wrap sleeve top edge towards a circumferential perforation ring oriented below the container opening.

Embodiments of a shrink wrap sleeve suitable for use for covering a portion of a container along a vertical axis having a circumference variation can have a top edge and bottom edge; the shrink wrap sleeve having a pair of generally vertical perforations descending from the shrink wrap sleeve top edge towards a circumferential perforation ring. Optional features of the present embodiments can include printed indicia and adhesive to bond the container to the shrink wrap sleeve. The shrink wrap sleeve of claim 14 can be a polyolefin, a polymer such as polyethylene terephthalate (PET), a copolymerized polyethylene terephthalate (PETG), polyethylene terephthalate glycol (PETG LV), polyvinyl chloride (PVC), polypropylene (PP), polyethylene (PE), and combinations thereof. Preferably the shrink wrap sleeve is a PETG, and even a PETG LV. The shrink wrap film can have a gauge of between about 40 to 55 microns, and preferably about 45 microns. The shrink wrap sleeve can have a shrinkage rate of about 75 percent to about 85 percent, and a shrinkage ratio of about 2:1.

Other features will become more apparent to persons having ordinary skill in the art to which the package pertains and from the following description and claims.

BRIEF DESCRIPTION OF THE DRAWINGS

The foregoing features, as well as other features, will become apparent with reference to the description and Figures below, in which like numerals represent like elements, and in which.

DETAILED DESCRIPTION OF PREFERRED EMBODIMENTS

Figure 1:
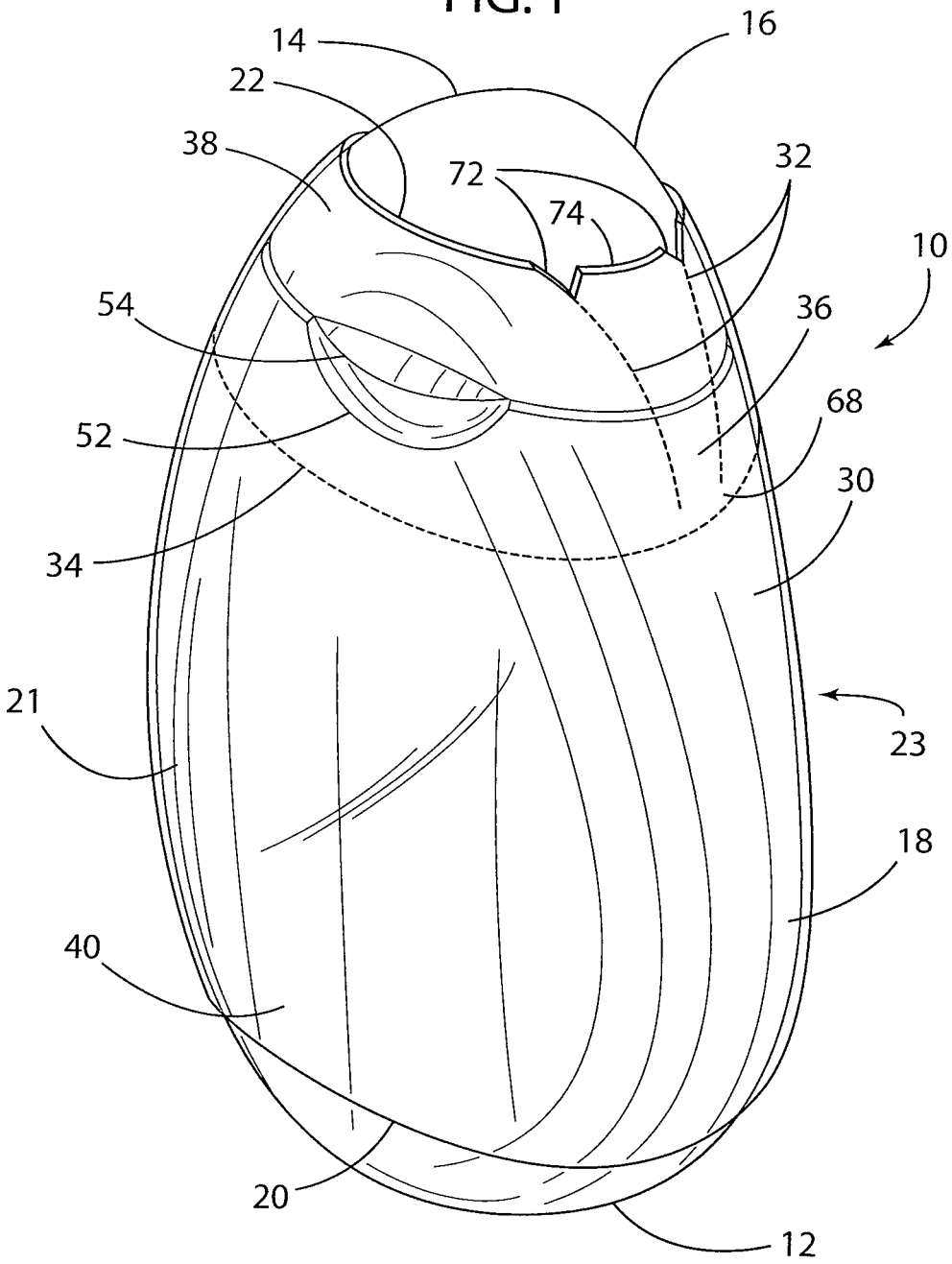
FIG. 1 is a front perspective view of one embodiment of an exemplary container having a perforated shrink wrap sleeve.

Provided herein are embodiments for perforated shrink wrap sleeves and containers with perforated shrink wrapped sleeves configured to provide easy partial removal, evidence of tamper, and product labeling—even with irregularly shaped and non-symmetrical containers.

Generally, the present embodiments illustrate a cost efficient and easy open feature for consumers to obtain full product access. As described, the present embodiments can provide printed surfaces to provide graphics and other types of printed information on a shrink wrapable film that can be transparent, translucent, opaque, or variations/combinations thereof. Metallic inks can also be provided to provide a silver or metallic hue. To accommodate container shape irregularities, a maximum to minimum shrinkage ratio should be at least 2:1. It is noted that various product container sizes are possible so long as the shrink wrap can be maintained thereon even after a partial band of film has been removed. Preferably, the shrink wrap film is applied as a sleeve. When a container bottom is present, it is preferably not encapsulated by the shrink wrap. On top tapered containers, the sleeve should terminate at a height on the container so that no 'puckering' would occur. For example, for the container embodiments illustrated in FIGS. 1 and 13, a sleeve is shown that is proportioned to reduce any evidence of a 'pucker' near the top and is not present on the bottom to allow the container to stand on its own.

The perforations of the present embodiments can permit removal of shrink wrap above the shoulder area, which allows access to a container opening, such as a flip top cap. The shrink wrap perforations provide a tamper evident feature in that once the perforations have been breached (ruptured) and/or a partial band of film material has been removed, it is visually obvious that the container has been opened. There are several perforation patterns described within the present embodiments, though it is noted that several other variations are possible. Nevertheless, the general features of the perforation patterns can provide two separate perforation types. A first pattern can be a pair of perforations axially oriented to the sleeve to form a tab; and a second pattern can be a generally circumferential ring pattern perpendicular to the axially oriented perforations to define an upper band for removal. The axial pair of perforations can terminate at or near (e.g., 1-5 mm or 1-3 perforations) above the circumferential ring. The patterns can be configured to remove the upper band of material in one motion or by removing first a vertical tab, and then the remaining portion of the upper band. The material for the shrink wrap should be configured to withstand multiple container flexing (e.g., at least 50 times). This feature is useful for a container that contains products, such as a beverage concentrate, that require the container to be squeezed to deliver product.

Turning now to the Figures, a container having a perforated shrink wrap sleeve is generally indicated at 10. As shown, the container 10 can be used to dispense a liquid concentrate in a desirable manner. The container 10 can include desirable properties, for example, to consistently discharge across a range of squeezed forces, generally consistent discharge with the same force without significant dependence on the amount of liquid concentrate in the container, a substantially dripless or leak proof outlet opening, a jet that minimizes splashing when the liquid concentrate enters another liquid, and a jet that maximizes mixing between the liquid concentrate and the other liquid. The container 10 utilizes some or all of these properties while dispensing a jet of the liquid concentrate into a target container having a target liquid therein. The container 10 described herein can dispense a liquid concentrate in such a way as to enter the target liquid without substantial splashing or splatter while also causing sufficient turbulence or mixing within the target container between the liquid concentrate and the target liquid to form a generally homogenous end mixture without the use of extraneous utensils or shaking.

Figure 13:
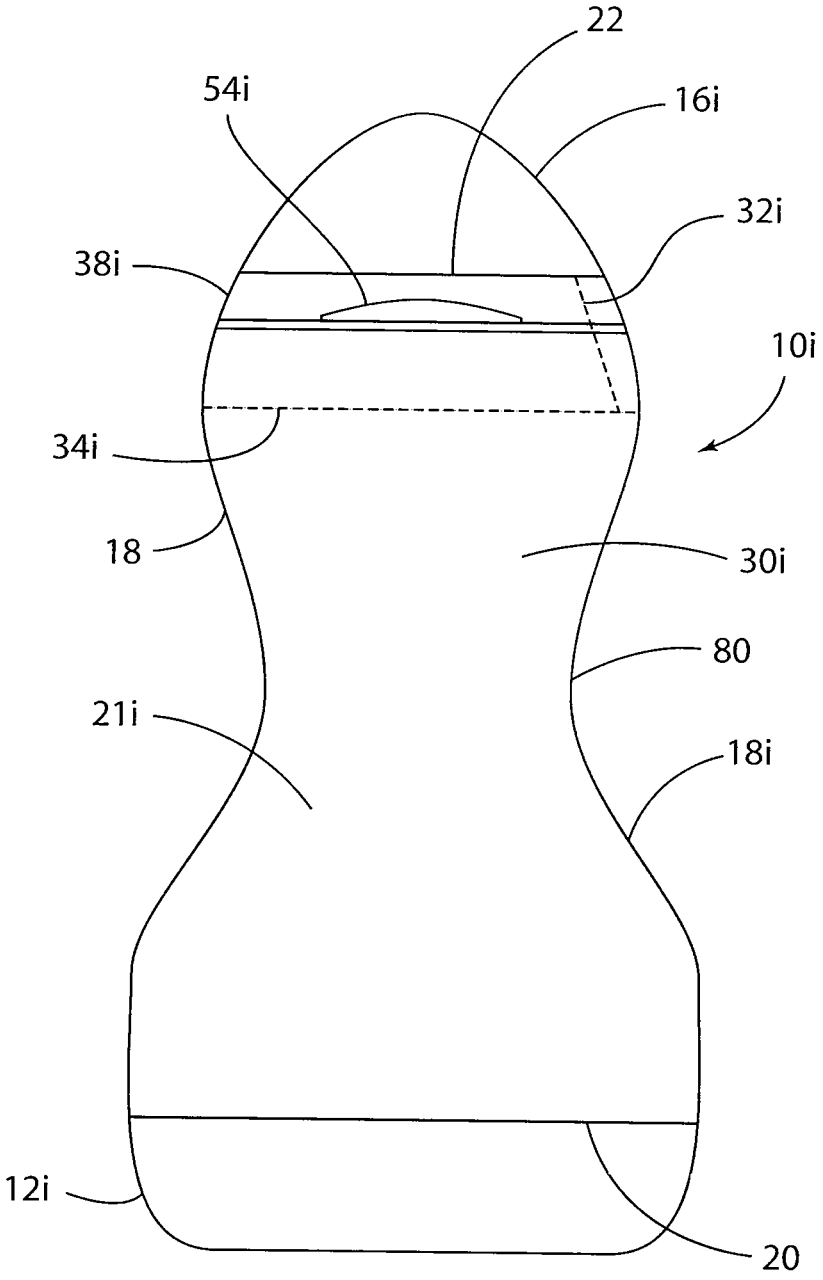
FIG. 13 is a front planar view of second embodiment of an exemplary container having a perforated shrink wrap sleeve.

Referring now to FIGS. 1 and 13, exemplary forms of the container 10 are shown with at least some, and preferably all, of the above properties. The container can include a closed, first end 12 and a top, second end 14 having a hinged flip top cap 16 secured to a back surface 23 by a hinge 44. The first end 12 and the flip top cap 16 can be connected by a generally tubular sidewall 18, which can take any suitable cross section, including any polygonal shape, any curvilinear shape, or any combination thereof, to form a container interior. Preferably, the container 10 can be sized for any number of uses and can specifically be in the range of 20 to 200 cc.

Exemplary shapes of the container 10 are illustrated in FIGS. 1 and 13 in which the first end 12 acts as a secure base for the container 10 to rest upon. The sidewall 18 can generally extend upward from the base or first end 12 to the second end 14. In the form of FIG. 1, the container 10 can have a generally 'egg' shape, where front and rear surfaces 21 and 23 respectively are curved to provide an ergonomic container shape. In another example in FIG. 13, the sidewalls 18 can include a 'waist' 80 so that the container 10 has an 'hourglass' shape on its front planar view.

Partially covering the container 10, including a seam for the flip top cap 16 can be a perforated shrink wrap sleeve 30 having two perforation patterns including generally a pair of vertical perforations 32 extending downward toward a horizontal (circumferential) perforation ring 34. The shrink wrap sleeve 30 can be a polyolefin such as polyethylene terephthalate (PET), a copolymerized polyethylene terephthalate (PETG), polyethylene terephthalate glycol (PETG LV—such as sold as a film by GILBRETH, Croydon, Pa., USA), polyvinyl chloride (PVC), polypropylene (PP), polyethylene (PE), and combinations thereof (or other shrinkable films). Preferably, the shrink wrap sleeve 30 is PETG. The gauge of the shrink wrap sleeve 30 can be about 40 to 55 microns, preferably about 45 microns. Shrinkage of the shrink wrap sleeve 30 can be at a shrinkage rate of about 75 percent to about 85 percent (preferably about 76 percent) and have a shrink ratio selected to preferably withstand a shrinkage ratio of about 2:1. The shrink wrap sleeve 30 can provide printed surfaces for graphics and other types of printed information or indicia on film that can be transparent, translucent, opaque, or various combinations thereof. Metallic inks can also be provided to provide a silver or metallic hue.

In the present embodiments, the container 10 preferably has a body having a circumference variation along an axis oriented to receive the shrink wrap sleeve 30, such as a vertical axis. It is noted that circumference by the present term can mean a perimeter variation and can include circles, ellipses and other various curvilinear or geometric shaped cross-sections. By way of illustration, container 10 is configured to receive a shrink wrap sleeve 30 along a vertical axis. The portion of the container body covered by shrink wrap sleeve 30 can have a circumference variation having a greater (FIG. 1, 18) or lesser (FIG. 13, 80) circumference at at least one point between the shrink wrap horizontal perforation ring 34 and a shrink wrap bottom edge 20 as compared to adjacent portions of the circumference. Alternately, the portion of the container body covered by the shrink wrap sleeve 30 can have a circumference variation having a greater (FIG. 1, 18) or lesser (FIG. 13, 80) circumference at at least one point between the shrink wrap top edge 22 and the shrink wrap bottom edge 20 as compared to adjacent portions of the circumference. This variation can preferably range from about 5 percent to about 200 percent, and most preferably at about 100 percent. Printing on a blank 28 (FIG. 12) for the shrink wrap sleeve 30 can have its printing distorted to accommodate circumference variation once the shrink wrap film has been applied to the container. For example, for the container 10 of FIG. 1 having a film height of about 80 mm and placed as shown in FIG. 1, distortion rates can be based on the following distortion percentage TABLE as follows:

TABLE

| Percent distortion | Vertical bottle height position (mm) |
|---|---|
| 135 | 62-80 |
| 117 | 50-62 |
| 110 | 15-50 |
| 120 | 0-15 |

The axial circumference variation can prevent the shrink wrap seal from slipping off the container before and/or after an upper band of shrink wrap is removed to expose a container opening, such as the illustrated flip top cap 16 and allow it to be opened for product removal. Alternately, an adhesive can be applied between the container 10 body and an inner surface of the shrink wrap sleeve 30 in various configurations.

The perforation patterns for the present embodiments can be varied but preferentially include a generally circumferential ring of perforations generally perpendicular to the vertical perforations 32. Horizontal perforations 34 for a vertically oriented shrink wrap sleeve 30, as illustrated, generally define an upper edge of the shrink wrap sleeve 30 remaining after the upper band 38 is removed to expose the container opening for product removal.

A second aspect of the shrink wrap sleeve 30 perforations is a pair of perforations that can run generally perpendicular to the circumferential ring of perforations. As illustrated for a vertically oriented shrink wrap sleeve, generally vertical perforations 32 can descend from the shrink wrap top edge 22 towards the horizontal ring perforation ring 34, which is oriented below access to the flip top cap 16. Access to flip top cap 16 can be by way of a recession portion 52 under a ledge 54. Again, many perforation pattern variations are possible within the scope of the embodiments. FIGS. 6-10 illustrate just a sample of these types of variations. The vertical perforations 32 can be parallel, converge, or expand as they extend (here, descend) towards the circumferential perforation ring 34. The vertical perforations 32 can terminate at the horizontal ring 34 or terminate at some point above the horizontal ring 34.

Figure 6A:
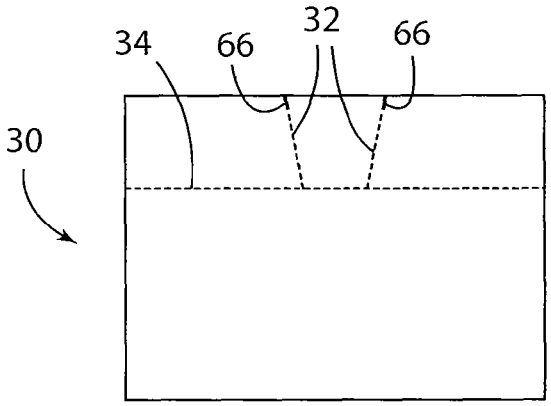
FIG. 6 illustrates one embodiment of an exemplary perforated shrink wrap sleeve in a front planar view (6*a*) and as a side view placed on a container (6*b*)
Figure 6B:
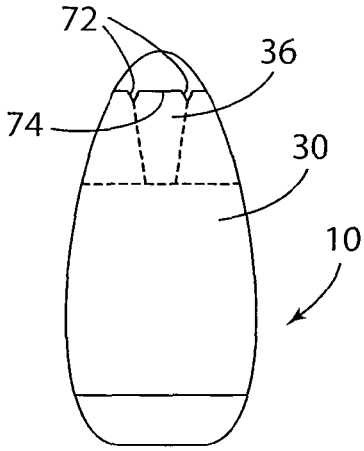

As illustrated, the vertical perforations preferably converge as they approach the horizontal ring 34. FIG. 6*a* shows a perforation pattern for a shrink wrap sleeve ready for placement and heat shrinking onto the container body 10. FIG. 6*b* illustrates the shrink wrap sleeve 30 after it has been applied to the container 10 and affixed to the container by heat shrinking or other means known in the art to shrink a film on a container. FIGS. 7-10 illustrate similar views for alternate perforation pattern embodiments. It is noted that any feature or the various embodiments can be interchanged within the other embodiments.

As to FIG. 6, the vertical perforations 32 converge as they approach and terminate at the horizontal line 34. Large cuts 66 are added to the top end of the vertical perforations 32 to provide a splitting effect, a "V" 72, when applied to the container 10. The pair of "V"s 72 provides a peel tab 74 to allow easy removal by a user. It is noted that as a user pulls on the peel tab 74, a vertical tab 36 is generated as the shrink wrap ruptures between the perforations. It is also noted that any ruptured patterns allow a visual inspection of the container to reveal whether the container has ever been opened or tampered with after shrink wrapping has been placed on the container.

Figure 7A:
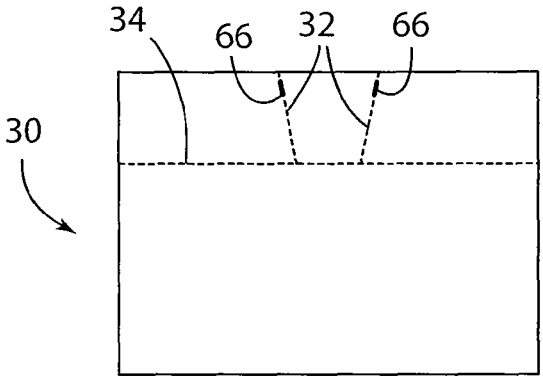
FIG. 7 illustrates a second embodiment of an exemplary perforated shrink wrap sleeve in a front planar view (7*a*) and as a side view placed on a container (7*b*)
Figure 7B:
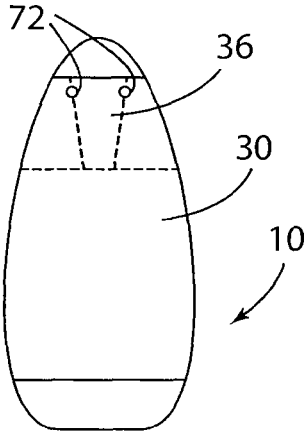

FIG. 7 shows a variation of the position of the large cut 66 below the top edge 22 of the shrink wrap sleeve 30. In other words, the large cut 66 is placed below one or more normal perforation cuts on the top edge of the sleeve 30. In this instance, the heat shrinking separates the shrink wrap to form a circular opening to assist in developing a vertical tab 36 without forming a distinct peel tab 74.

Figure 8A:
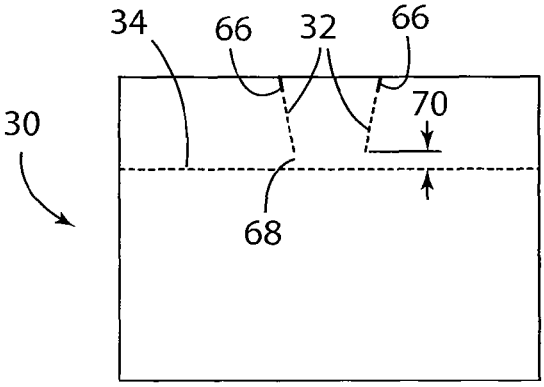
FIG. 8 illustrates a third embodiment of an exemplary perforated shrink wrap sleeve in a front planar view (8*a*) and as a side view placed on a container (8*b*)
Figure 8B:
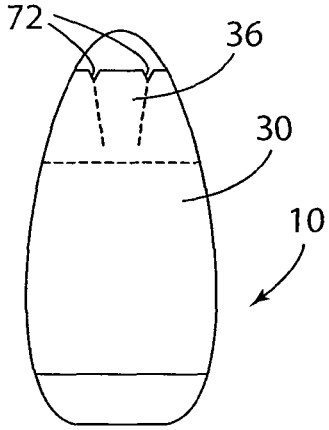
Figure 9A:
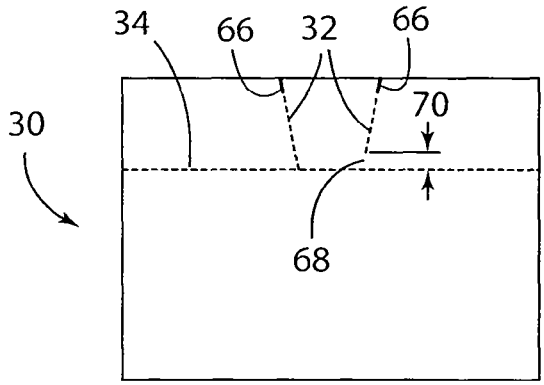
FIG. 9 illustrates a fourth embodiment of an exemplary perforated shrink wrap sleeve in a front planar view (9*a*) and as a side view placed on a container (9*b*)
Figure 9B:
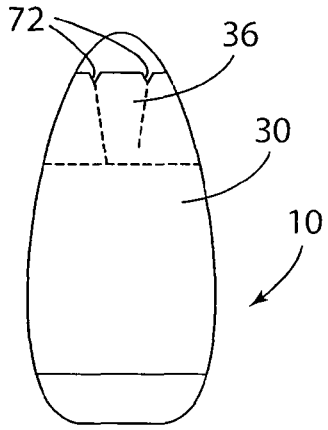

FIG. 8 shows a variation of the perforation pattern by terminating the vertical perforations 32 before they reach the horizontal ring 34. This can be defined by not placing one, two, or three perforations before it reaches horizontal ring 34. For a container of about 80 mm in height, this non-perforated area 68 can have a dimension 70 of about 1 to 5 mm, and preferably about 1 to 2 mm. FIG. 9 illustrates where only one of vertical perforations 32 has a non-perforated area 68.

Figure 10A:
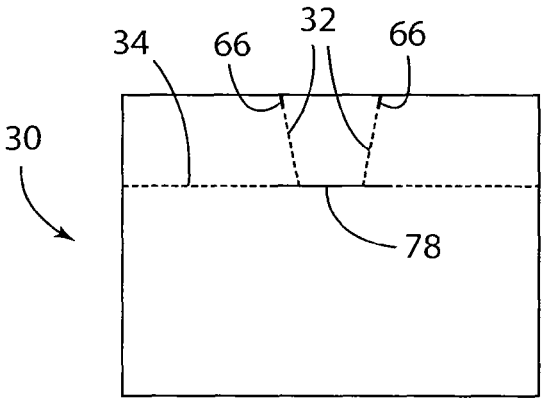
FIG. 10 illustrates a fifth embodiment of an exemplary perforated shrink wrap sleeve in a front planar view (10*a*) and as a side view placed on a container (10*b*)
Figure 10B:
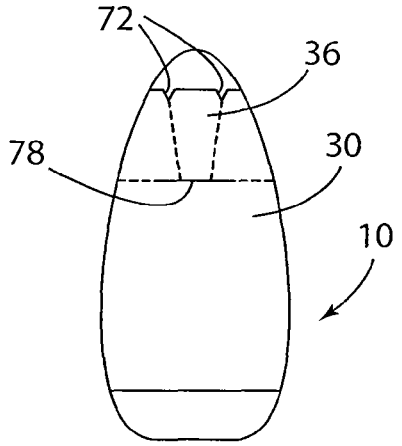

FIG. 10 illustrates a horizontal cut 78 so that as the vertical tab 36 is removed (See, e.g., FIG. 2) it separates from the shrink wrap sleeve 30 when it reaches the horizontal perforation ring.

Figures 2, 3, 4:
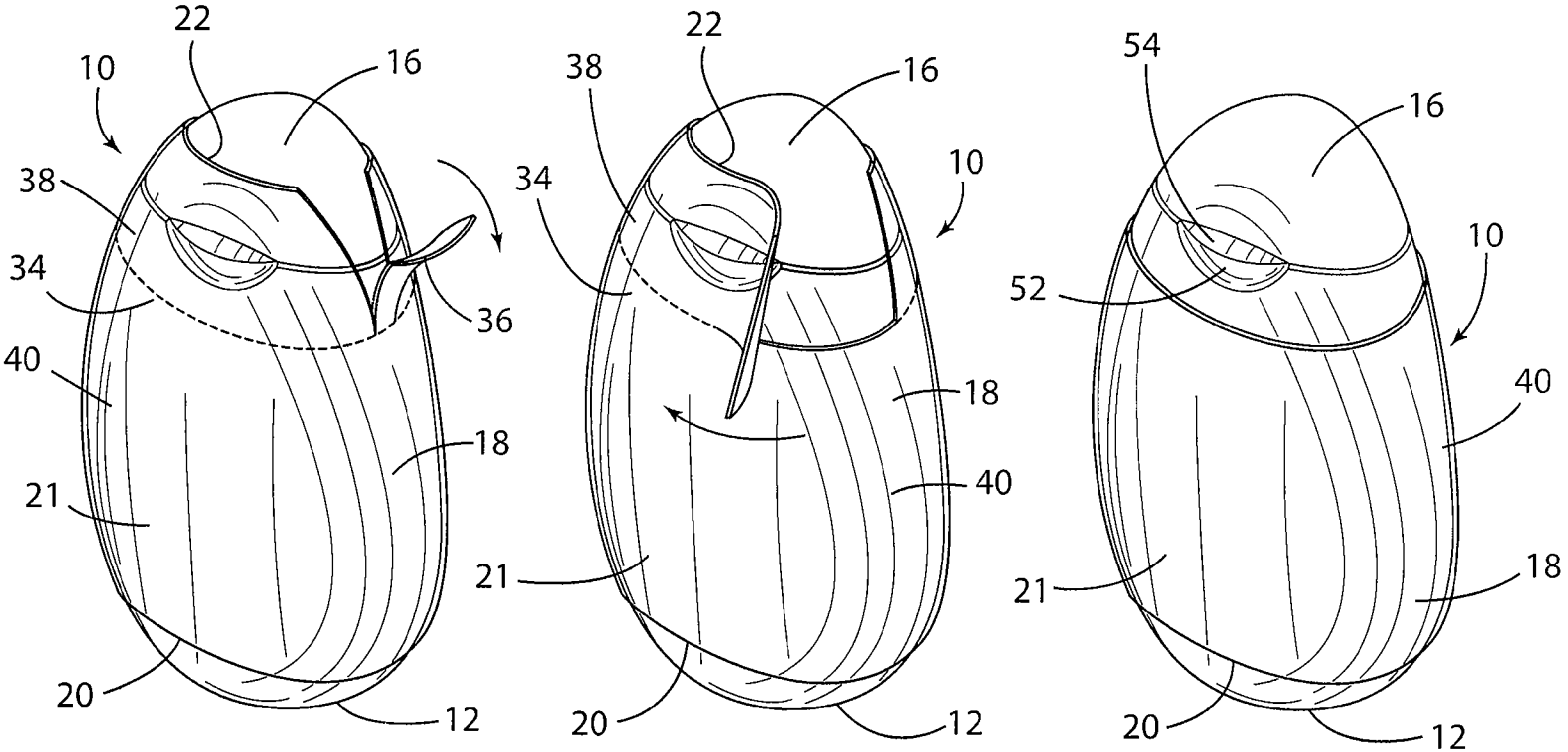
FIG. 2 is a front perspective view of one embodiment of an exemplary container having a perforated shrink wrap sleeve with a first perforation peeled away.
FIG. 3 is a front perspective view of one embodiment of an exemplary container having a perforated shrink wrap sleeve with a first perforation removed and a second perforation peeled partially away.
FIG. 4 is a front perspective view of one embodiment of an exemplary container having a perforated shrink wrap sleeve with a first and second perforation peeled away.
Figure 5:
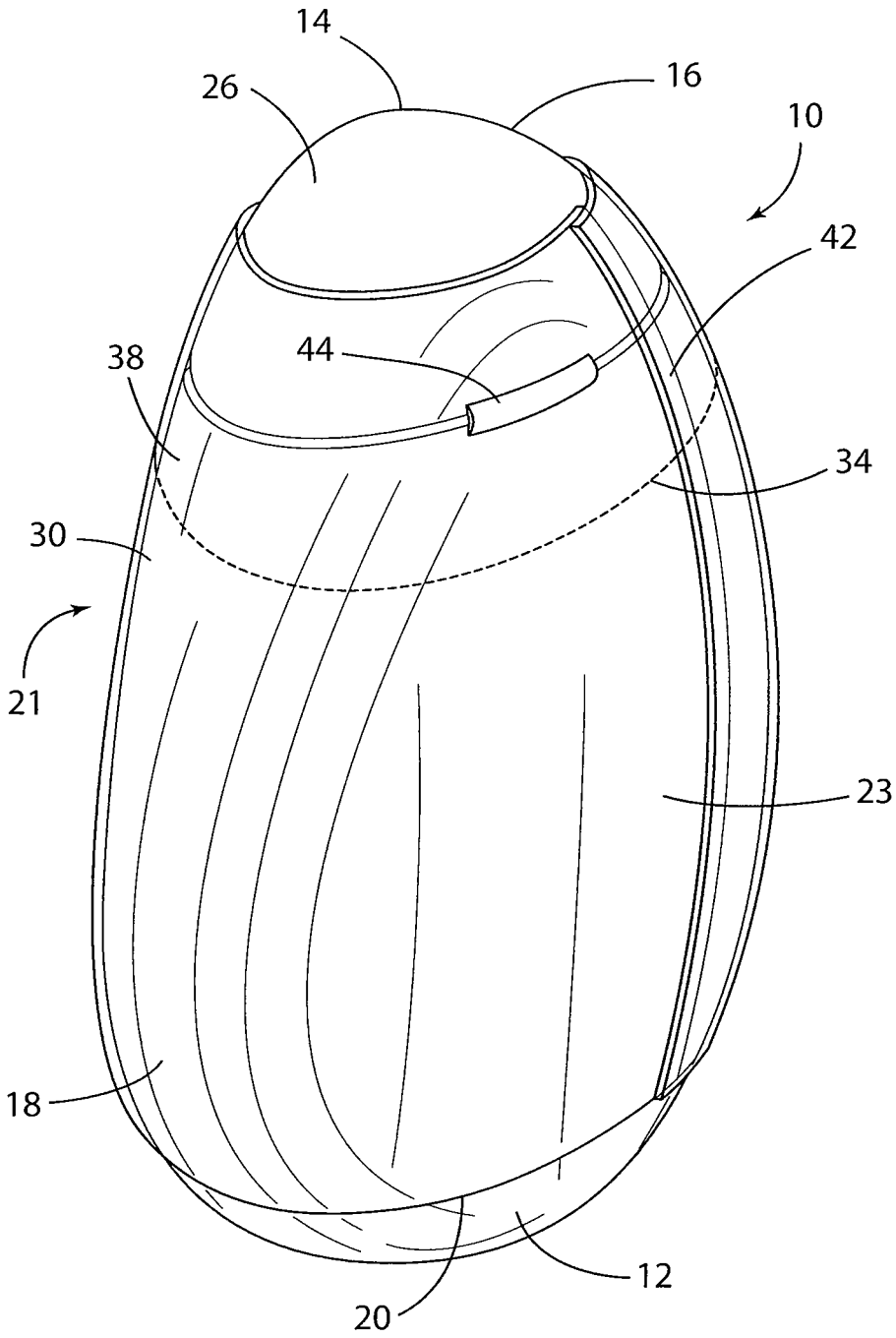
FIG. 5 is a rear perspective view of one embodiment of an exemplary container having a perforated shrink wrap sleeve.

In use, as shown in the sequence of FIGS. 2-4, a user can pinch the tab 74 and pull the shrink wrap toward the horizontal ring 34 to form the vertical tab 36 (FIG. 1). Depending on the perforation pattern, a user can continuously pull the vertical tab 36 until it approaches the horizontal ring 34, followed by a horizontal pull (FIG. 2) to continue the shrink wrap rupture of the horizontal ring perforations until an upper shrink wrap band 38 is removed (FIG. 3). Once the band 38 is removed, the lower shrink wrap band 40 remains and the product is ready for use.

Figures 11, 12:
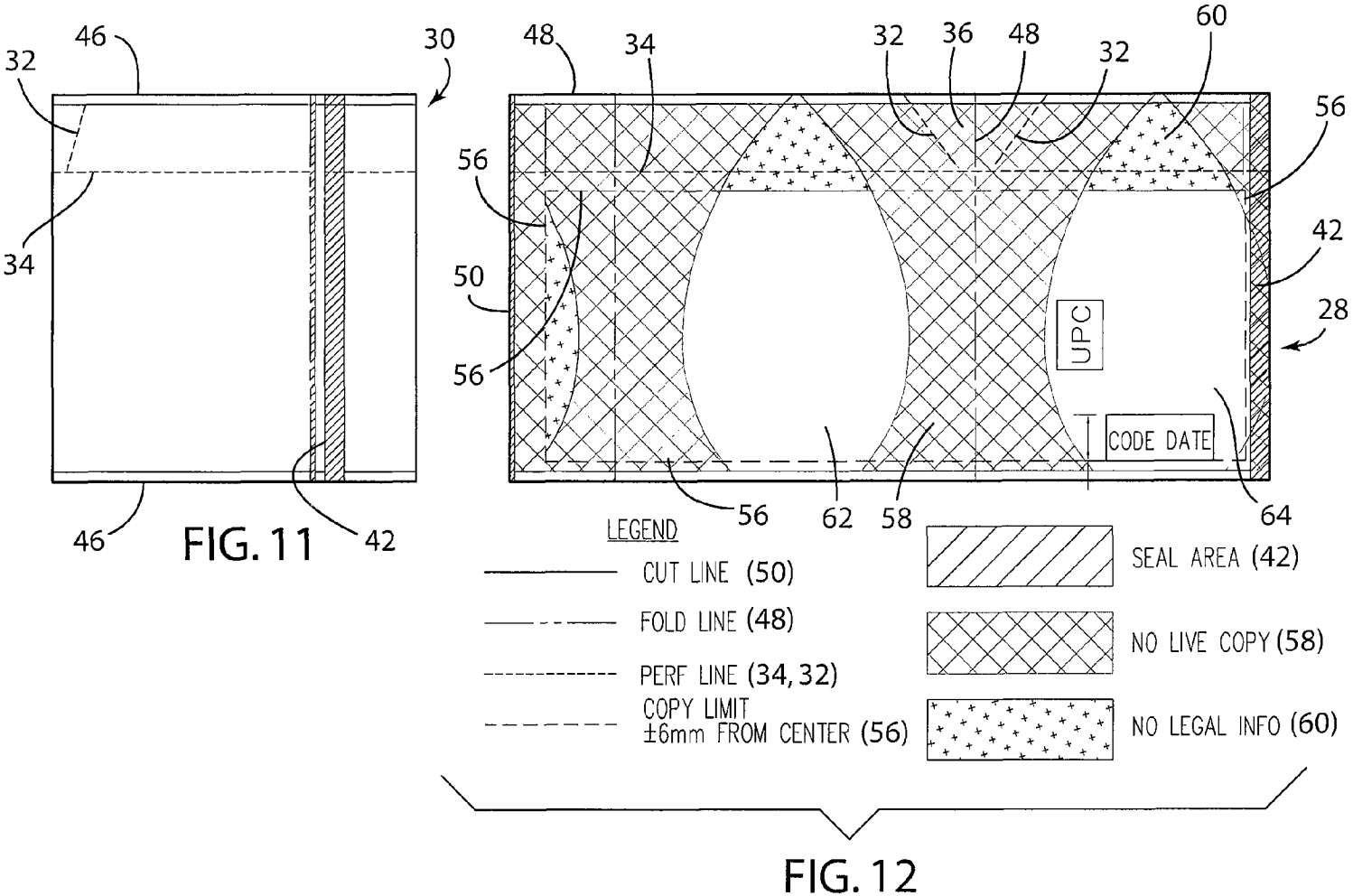
FIG. 11 illustrates one embodiment of an exemplary perforated shrink wrap sleeve in a rear planar view.
FIG. 12 illustrates a blank of one embodiment of a shrink wrap sleeve for a container.

The shrink wrap 30 can be formed by a blank 28 from a continuous film of PETG as shown in FIG. 12. As shown in FIG. 12, cut lines 50 define the size of the sleeve blank 28 as well as fold lines 48, seal area 42, copy limit 56, no live copy 58, no legal information 60 (since that portion on the shrink wrap will be removed prior to use), front panel print 62, and rear panel print 64. Once a blank has been formed, the film is sealed at the seal area 42 and the perforations 32 and 34 are added to form the shrink wrap seal that is ready for placement on the container 10. It is noted that there are limitless variations that are possible to forming blanks for heat shrinking onto a container.

While preferred embodiments have been described in detail, variations and modifications can be effected within the cope of the presented embodiments.

The invention claimed is:

1. A container containing a liquid concentrate and configured for squeezing to dispense a jet of the liquid concentrate, the container comprising:

a container body having a circumference/perimeter variation along a vertical axis, a bottom surface, and a flip top cap having a moveable hinged part having a top surface, the container body having a pair of sidewalls extending between front and rear surfaces, the sidewalls converging toward the flip top cap, the front and rear surfaces each having a greater maximum width than the sidewalls;

an axially oriented shrink wrap sleeve covering a portion of the body of the container having a circumference variation and a portion of the hinged part, and a bottom edge of the shrink wrap sleeve being spaced from the bottom surface;

the shrink wrap sleeve having a pair of generally vertical perforations descending from a shrink wrap top edge towards a circumferential perforation ring oriented below the moveable hinged part, the circumferential perforation ring extending between the pair of generally vertical perforations;

wherein the shrink wrap sleeve covering a portion of the container body circumference variation has one of a smaller or larger circumference at at least one point between the circumferential perforation ring and the bottom edge as compared to adjacent portions both above and below the circumference variation in order to prevent the shrink wrap sleeve from slipping off the container after removal of the portion thereof extending between the circumferential perforation ring and the top edge;

a span of an exterior of the container extending from immediately below the moveable hinged part to an opposite side of the circumferential perforation ring, the span including a continuously increasing circumference extending away from the moveable hinged part and toward the bottom of the container; and wherein the hinged part of the cap is moveable about a protruding hinge and the top edge of the shrink wrap sleeve terminates at a height such that the hinge is completely covered by the shrink wrap sleeve such that there are no gaps between the top edge of the shrink wrap sleeve and the hinged part of the cap above the hinge.

2. The container of claim 1, wherein the axially oriented shrink wrap sleeve covering a portion of the container body circumference variation has a greater circumference at at least one point between the shrink wrap circumferential perforation ring and the bottom edge.

3. The container of claim 1, wherein the axially oriented shrink wrap sleeve covering a portion of the container body circumference variation has a smaller circumference at at least one point between the circumferential perforation ring and the bottom edge.

4. The container of claim 1, wherein the generally vertical perforations descending from the shrink wrap top edge are progressively closer together as they approach the circumferential perforation ring.

5. The container of claim 1, wherein the generally vertical perforations descending from the shrink wrap top edge terminate at the circumferential ring.

6. The container of claim 1, wherein the generally vertical perforations descending from the shrink wrap top edge terminate at a space of about two perforations above the circumferential perforation ring.

7. The container of claim 4, wherein the generally vertical perforations descending from the shrink wrap top edge begin with an initial perforation cut, followed by relatively smaller perforation cuts, configured so that when the shrink wrap is applied to the container body, each of the larger cuts forming a 'V' shape at a top of each vertical perforation to define a tab between the vertical perforations.

8. The container of claim 1, wherein the front and rear surfaces of the container body are generally planar, and a seal of the shrink wrap sleeve is vertically oriented along the rear surface.

9. The container of claim 1, wherein the shrink wrap sleeve is a polymer selected from the list consisting of: polyethylene terephthalate (PET), a copolymerized polyethylene terephthalate (PETG), polyethylene terephthalate glycol (PETG LV), polyvinyl chloride (PVC), polypropylene (PP), and polyethylene (PE).

10. The container of claim 1, wherein the shrink wrap sleeve has a shrinkage rate of about 75 percent to about 85 percent.

11. The container of claim 1, wherein the shrink wrap sleeve has a shrinkage ratio of about 2:1.

12. The container of claim 1 further comprising a seam for the flip top cap, said seam being covered by the shrink wrap sleeve, said shrink wrap sleeve being at least partly opaque.

13. The container of claim 12, wherein a recession portion is disposed immediately below the moveable hinged part and above the circumferential perforation ring.

14. The container of claim 12, wherein the seam is between the circumferential perforation ring and the bottom edge so that the shrink sleeve assists in maintaining the flip top cap on the container body after removal of the portion of the shrink sleeve extending between the circumferential perforation ring and the top edge.

15. The container of claim 1, wherein the shrink sleeve terminates at a height on the container so that no puckering occurs.

16. The container of claim 1, wherein the increasing circumference is predominately in the sidewalls as compared to the front and rear surfaces.

17. The container of claim 16, wherein the pair of generally vertical perforations of the shrink sleeve is disposed adjacent one of the sidewalls.

18. The container of claim 1, wherein the shrink wrap sleeve has no legal information above the circumferential perforation ring.

19. The container of claim 1, wherein the top edge of the shrink wrap sleeve terminates at a height allowing the top surface to remain exposed.

20. The container of claim 1, wherein the circumferential perforation ring extends between the pair of generally vertical perforations on both sides thereof and only a single circumferential perforation ring is provided in the sleeve.

21. The container of claim 1, wherein the span of the exterior of the container extends from at a bottom edge of the moveable hinged part to the opposite side of the circumferential perforation ring and the entirety of the span has a continuously increasing circumference extending away from the moveable hinged part and toward the bottom of the container.

22. The container of claim 1, wherein only a single circumferential perforation ring is provided in the sleeve.

23. The container of claim 1, wherein a seal of the shrink wrap sleeve is vertically oriented along the rear surface, the increasing circumference is predominately in the sidewalls as compared to the front and rear surfaces, and the pair of generally vertical perforations of the shrink wrap sleeve is disposed adjacent one of the sidewalls.

24. The container of claim 23, wherein the seal of the shrink wrap sleeve is disposed more than ninety degrees about the circumference of the container from the pair of generally vertical perforations of the shrink wrap sleeve.

25. The container of claim 1, wherein the bottom surface is configured to support the container in an upright configuration.

26. The container of claim 15, wherein the hinged part of the cap is moveable about a protruding hinge and the top edge of the shrink wrap sleeve terminates at a height such that the hinge is completely covered by the shrink wrap sleeve.

27. The container of claim 1, wherein a maximum distortion of the shrink wrap sleeve is in the upper 77.5% of the height of the sleeve.

28. The container of claim 22, wherein there is no direct intersection between the circumferential perforation ring and the vertical perforations.

* * * * *